US010729608B2

(12) United States Patent
Venosi

(10) Patent No.: US 10,729,608 B2
(45) Date of Patent: Aug. 4, 2020

(54) ARTICLE FOR RECEIVING A BODY OF AN ANIMAL

(71) Applicant: Sweet Goodbye Pty Ltd, Dunsborough WA (AU)

(72) Inventor: Natalie Venosi, Dunsborough WA (AU)

(73) Assignee: SWEET GOODBYE PTY LTD, Dunsborough WA (AU)

( * ) Notice: Subject to any disclaimer, the term of this patent is extended or adjusted under 35 U.S.C. 154(b) by 134 days.

(21) Appl. No.: 15/892,502

(22) Filed: Feb. 9, 2018

(65) Prior Publication Data

US 2018/0333319 A1 Nov. 22, 2018

(30) Foreign Application Priority Data

May 18, 2017 (SG) ..... 10201704079Q

(51) Int. Cl.
*A61G 17/06* (2006.01)
*A61G 17/02* (2006.01)
*A61G 17/007* (2006.01)

(52) U.S. Cl.
CPC ..... *A61G 17/06* (2013.01); *A61G 17/007* (2013.01); *A61G 17/034* (2017.05)

(58) Field of Classification Search
CPC .... A61G 17/06; A61G 17/007; A61G 17/047; A61G 17/034; B65D 31/02; B65D 31/04
USPC ..... 27/28; 383/98, 113
See application file for complete search history.

(56) References Cited

U.S. PATENT DOCUMENTS 4,895,171 A * 1/1990 Onik ..... A61F 13/00 128/869
5,341,548 A * 8/1994 Zerick ..... A22B 7/008 190/125
6,574,840 B1 * 6/2003 Doppel ..... A61G 17/00 27/19
9,849,055 B2 * 12/2017 Vertsteylen ..... A61G 17/047
2007/0009187 A1 * 1/2007 Adamo ..... A01N 1/00 383/41
2009/0007402 A1 * 1/2009 Carroll ..... A61G 17/06 27/28
2009/0080811 A1 * 3/2009 Stefanek ..... A41D 27/245 383/61.3
2010/0263178 A1 * 10/2010 Jensen ..... A61G 17/06 27/28
2013/0174392 A1 * 7/2013 Chua ..... A61G 17/06 27/28

(Continued)

*Primary Examiner* — William L Miller
(74) *Attorney, Agent, or Firm* — Wood, Phillips, Katz, Clark & Mortimer

(57) ABSTRACT

An article for receiving a body of an animal and a method for containing fluid released from a body of an animal are disclosed. The article includes an absorbent layer having an inner side and an outer side opposite the inner side, wherein the absorbent layer is configured to be placed proximate to the body to absorb fluid released from the body; a liquid impermeable sheet attached to the outer side of the absorbent layer and configured to prevent the fluid released from the body from seeping through the liquid impermeable sheet; and an outer layer attached to the liquid impermeable sheet. At least the outer layer is configured to form an outer pouch to contain the body. The outer layer includes closure means configured to secure the body within the outer pouch.

11 Claims, 19 Drawing Sheets

(56) References Cited

U.S. PATENT DOCUMENTS

| | | | | |
|---|---|---|---|---|
| 2014/0259577 | A1* | 9/2014 | Richardson | A61G 17/06 27/28 |
| 2015/0290068 | A1* | 10/2015 | Schiavone | A61G 17/06 27/28 |
| 2016/0176622 | A1* | 6/2016 | Vertsteylen | A61G 17/047 206/205 |

* cited by examiner

ARTICLE FOR RECEIVING A BODY OF AN ANIMAL

FIELD OF INVENTION

The present invention relates broadly to an article for receiving a body of an animal.

BACKGROUND

The decease of a pet animal is a distressing event to a pet owner. However, this is always unavoidable since a pet owner usually outlives his/her pet animal. Often, a container, such as a bag or a coffin, is used for containing the body of a deceased pet animal for transportation, burial or cremation purpose. Different containers can be chosen, depending on the shape and size of the deceased pet animal.

There are limited options available in the market for containing a deceased pet animal. Some of the options include clinical zippered body bags, drawstring bags and garbage bags. However, many of these existing containers are not suitable for the transportation, burial or cremation of deceased pet animals. For example, the containers do not provide a portable structure that can snugly hold the pet animal during portage of the containers without the body of the pet animal moving precariously within the containers.

Additionally, it is known that deceased pet animals release body fluid upon passing. Most of the containers are not able to manage the body fluid released. Due to the movement of the pet animals in the containers or otherwise, it is likely that the fluid will leak from the containers. Thus, the process of transporting, burying, or cremating deceased pet animals using the existing containers can be difficult due to the movement of the pet animals in the containers and the leakage of the body fluid from the containers.

Moreover, the existing containers may have other shortcomings. For example, most of the containers are not made of environmentally friendly materials and are thus harmful to the environment. Also, pet owners generally wish to say goodbye to a beloved pet in a way that honours their life in a respectful way. It is noted that most of the existing containers are not aesthetically pleasing. Some containers are used for clinical purposes only, for e.g. to avoid potential risk of infection, and do not provide any sense of ceremony or comfort to the pet owner who is deeply saddened by the loss of the pet animal. Thus, the existing containers are not suitable to be used as a final resting place of a much loved pet animal.

A need therefore exists to provide an article that seeks to address at least some of the problems above or to provide a useful alternative.

SUMMARY

According to a first aspect of the present invention, there is provided an article for receiving a body of an animal, the article comprising:

an absorbent layer comprising an inner side and an outer side opposite the inner side, wherein the absorbent layer is configured to be placed proximate to the body to absorb fluid released from the body;

a liquid impermeable sheet attached to the outer side of the absorbent layer and configured to prevent the fluid released from the body from seeping through the liquid impermeable sheet; and an outer layer attached to the liquid impermeable sheet, wherein at least the outer layer is configured to form an outer pouch to contain the body, and wherein the outer layer comprises closure means configured to secure the body within the outer pouch.

The article may further comprise an inner layer attached to the inner side of the absorbent layer, wherein the inner layer is configured to form an inner pouch to receive the body.

The absorbent layer, liquid impermeable sheet, and outer layer may be made of biodegradable materials.

The absorbent layer may comprise one or more towels made of natural fibre.

The liquid impermeable sheet may comprise one or more bioplastic sheet.

The outer layer may be made of a fluid-repellent material.

The outer layer may be made of wool felt.

The outer pouch may be adjustable in size.

The closure means may comprise overlapping flaps such that the size of the outer pouch is adjusted based on the extent of the overlap.

The closure means may comprise a plurality of buttons and a plurality of buttonholes, wherein the size of the outer pouch is adjusted based on the extent the plurality of buttons and buttonholes being fastened together.

The article may further comprise a cradle attached to the outer layer, wherein the cradle is configured to allow the outer pouch to be lifted and carried.

According to a second aspect of the present invention, there is provided a method for containing fluid released from a body of an animal, the method comprising:

wrapping the body with an article, the article comprising an absorbent layer comprising an inner side and an outer side opposite the inner side, a liquid impermeable sheet attached to the outer side of the absorbent layer, and an outer layer attached to the liquid impermeable sheet, such that the absorbent layer is proximate to the body to absorb fluid released from the body; and securing the outer layer, such that at least the outer layer forms an enclosed outer pouch to contain the fluid.

The method may further comprise the steps of:

securing an inner layer, such that the inner layer forms an inner pouch; and disposing the inner pouch onto the inner side of the absorbent layer.

The absorbent layer, liquid impermeable sheet, and outer layer may be made of biodegradable materials.

The absorbent layer may comprise one or more towels made of natural fibre.

The liquid impermeable sheet may comprise one or more bioplastic sheet.

The outer layer may be made of a fluid-repellent material.

The outer layer may be made of wool felt.

Securing the outer layer may comprise adjusting the size of the outer pouch based on the size of the body.

Adjusting the size of the outer pouch may comprise adjusting the extent of overlap between overlapping flaps.

Adjusting the size of the outer pouch may comprise adjusting the extent of a plurality of buttons and buttonholes being fastened together.

BRIEF DESCRIPTION OF THE DRAWINGS

Embodiments of the invention will be better understood and readily apparent to one of ordinary skill in the art from the following written description, by way of example only, and in conjunction with the drawings, in which.

DETAILED DESCRIPTION

In the following description, the article is used for receiving a body of a deceased animal for burial or cremation purpose. It should be noted that the article can also be used for other purposes, such as a vessel for ashes after cremation, a travel pouch, or a sleeping pouch for pet animals in other implementations. Further, the veterinarian can also perform euthanasia to an animal on or in the bag, thus eliminating the need to handle the body after the animal has passed.

Figure 1:
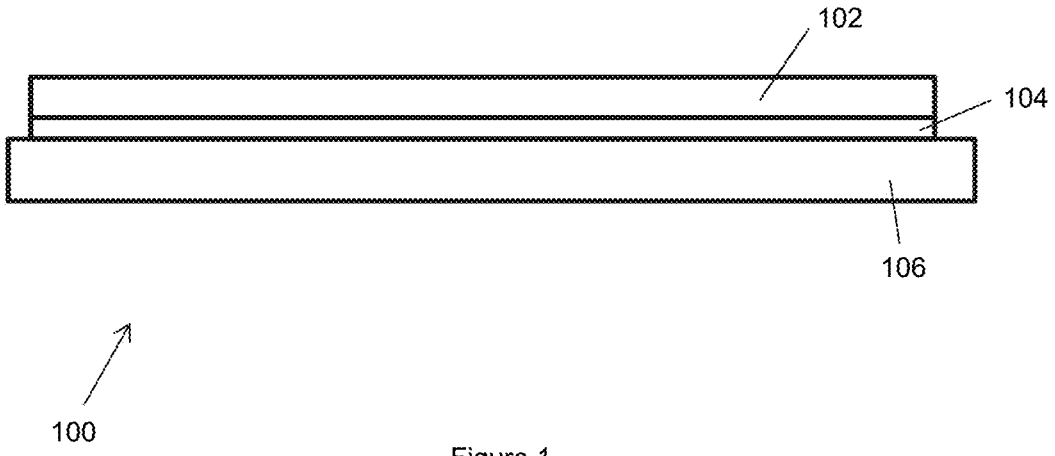
FIG. 1 shows a diagram illustrating an article for receiving a body of an animal according to an example embodiment.

FIG. 1 shows a diagram illustrating an article 100 for receiving a body (not shown) of an animal according to an example embodiment. The article 100 comprises an absorbent layer 102. The absorbent layer 102 comprising an inner side and an outer side opposite the inner side, wherein the absorbent layer 102 is configured to be placed proximate to the body to absorb fluid released from the body. The article 100 further comprises a liquid impermeable sheet 104 which is attached to the outer side of the absorbent layer 102. The liquid impermeable sheet 104 is configured to prevent the fluid released from the body from seeping through the liquid impermeable sheet 104. The article 100 further comprises an outer layer 106 which is attached to the liquid impermeable sheet 104. At least the outer layer 106 is configured to form an outer pouch to contain the body. The outer layer 106 comprises closure means configured to secure the body within the outer pouch.

Generally, the absorbent layer 102 and liquid impermeable sheet 104 are made of a material that is relatively lightweight and flexible. This makes the carrying and handling of the article 100 easier. Further, the absorbent layer 102, liquid impermeable sheet 104, and outer layer 106 are made of biodegradable materials. In an embodiment, the article 100 can be decomposed within 12 to 17 weeks in a composting environment. Thus, the use of the article 100 may not cause pollutions to the environment.

The absorbent layer 102 comprises a towel made of natural fibre, for e.g. wood or vegetable fibre, that is capable of absorbing a substantial volume of fluid released from the body. Deceased animals may release different volumes of fluid depending on the body size. Thus, the capacity of the absorbent layer 102 should be sufficiently large to absorb the fluid released by the largest animal that can fit into that particular article 100. For example, a big dog may release 400-500 ml of fluid upon passing. Thus, the absorbent layer 102 in the article 100 should have the capacity to absorb the volume of fluid or more, e.g. with 1 litre capacity, without leakage of fluid to the outer layer 106. In an embodiment, the absorbent layer 102 is cut into a suitable size, typically similar with or smaller than the size of the liquid impermeable sheet 104. The outer side of the absorbent layer 102 is stitched to the liquid impermeable sheet 104.

It will be appreciated that the absorbent layer 102 may comprise more than one towel that is lined on each other to form a thicker layer of absorbent layer 102. This may increase the capability of the absorbent layer 102 to absorb fluid. Further, the absorbent layer 102 can be made of other materials that are fluid absorbent, e.g. paper or synthetic fibre. Also, the absorbent layer 102 can be attached to the liquid impermeable sheet 104 using means other than stitches, e.g. using a suitable adhesive.

The liquid impermeable sheet 104 is made of a type of polymer, such as a petrobased or biobased polymer. In an embodiment, the liquid impermeable sheet 104 is a bioplastic sheet derived from natural sources, e.g. a corn starch-based bioplastic. The liquid impermeable sheet 104 is cut into a suitable size and stitched to an inner side of the outer layer 106. The fluid-proof property of the liquid impermeable sheet 104 may advantageously prevent the fluid released from the body to reach the outer layer 106. This may allow the fluid released from the body to be absorbed by the absorbent layer 102 without wetting the outer layer 106.

It will be appreciated that the liquid impermeable sheet 104 may comprise more than one bioplastic sheet. The bioplastic sheets are lined on each other to form a thicker layer of liquid impermeable sheet 104. This may increase the strength of the liquid impermeable sheet 104 and its ability to resist the fluid from flowing through the liquid impermeable sheet 104. Further, the liquid impermeable sheet 104 can be made of other materials that are fluid-proof, e.g. aliphatic-aromatic co-polyester. Also, the liquid impermeable sheet 104 can be attached to the outer layer 106 using means other than stitches, for e.g. using a suitable adhesive.

A combination of the absorbent layer 102 and liquid impermeable sheet 104 may advantageously keep the outer layer 106 dry. The absorbent layer 102 with superior fluid absorption capability absorbs the fluid, thus preventing the liquid impermeable sheet 104 from coming into direct contact with a full volume of fluid released from the body. The article 100 can be easily handled without the fluid flowing freely within the article 100 when in use. The liquid impermeable sheet 104 prevents the fluid from seeping through the liquid impermeable sheet 104 to the outer layer 106. For example, the fluid absorbed by the absorbent layer 102 or the fluid released from the body may be prevented from reaching the outer layer 106. Thus, the combination of the absorbent layer 102 and liquid impermeable sheet 104 may advantageously inhibit a leakage of fluid through the outer layer 106.

In an embodiment, the outer layer 106 is made of a natural or synthetic material which is fluid-repellent, thus preventing fluid from seeping through the outer layer 106. Also, the outer layer 106 is typically made of a durable material to prevent the outer layer 106 from being torn and/or worn, since it would be in contact with the person holding the article 100 or an external unit (such as a cradle) during portage of the article 100. The water repellent and durable natures of the material may also protect the deceased animal from external hazards, e.g. risk of being disturbed or eaten by other animals. This may be comforting to the animal owner even though the animal is deceased. An example of the material is wool felt. The outer layer 106 can be hand-woven or factory-manufactured.

The outer layer 106 is configured to form an outer pouch to contain the body. The outer pouch is adjustable in size to accommodate bodies of different sizes and to secure the body within the outer pouch. In an embodiment, the outer layer 106 is a flat layer of wool felt (described in further details below in respect of FIGS. 2A-2C) foldable transversely to form the outer pouch that contain the body. In another embodiment, the outer layer 106 is a sleeve made of wool felt fabric (described in further details below in respect of FIGS. 4A and 4B), wherein the sleeve can be closed with a closure flap to form the outer pouch that contain the body.

The outer layer 106 includes a base portion. The base portion is at an inner side of the outer layer 106 and is configured to be placed substantially underneath the body. Typically, the base portion is around the centre of the outer layer 106. Often, the body is allowed to sit in the bag for a period of time before being attended to. Since the base portion is placed substantially underneath the body, most of the fluid released from the body would flow to the base portion. In an embodiment, the absorbent layer 102 and liquid impermeable sheet 104 are attached to the base portion to prevent the fluid from seeping through the base portion and from being seen or felt externally.

The article 100 further comprises an inner layer, such as a shroud. The shroud is disposed on the inner side of the absorbent layer 102 and is stitched to the outer layer 106. In use, the shroud is laid out flat to receive the body. The shroud is then folded inward to wrap around the body, forming an inner pouch. In an embodiment, the shroud comprises one or more pairs of straps (not shown) that can be drawn from opposite sides of the shroud. Each pair of the strap can be tied together after the body is wrapped within the shroud, thus keeping the position of the body within the shroud. It will be appreciated that the shroud may be printed with patterns to enhance the appearance of the shroud. For example, the shroud may be printed with mandala design that includes colours which match with the colour of the outer layer 106. It will be appreciated that the shroud can be made of one or more flexible materials, such as cotton, wool felt or jute fabric. Further, the shroud may be produced using natural or synthetic material.

Figure 2A:
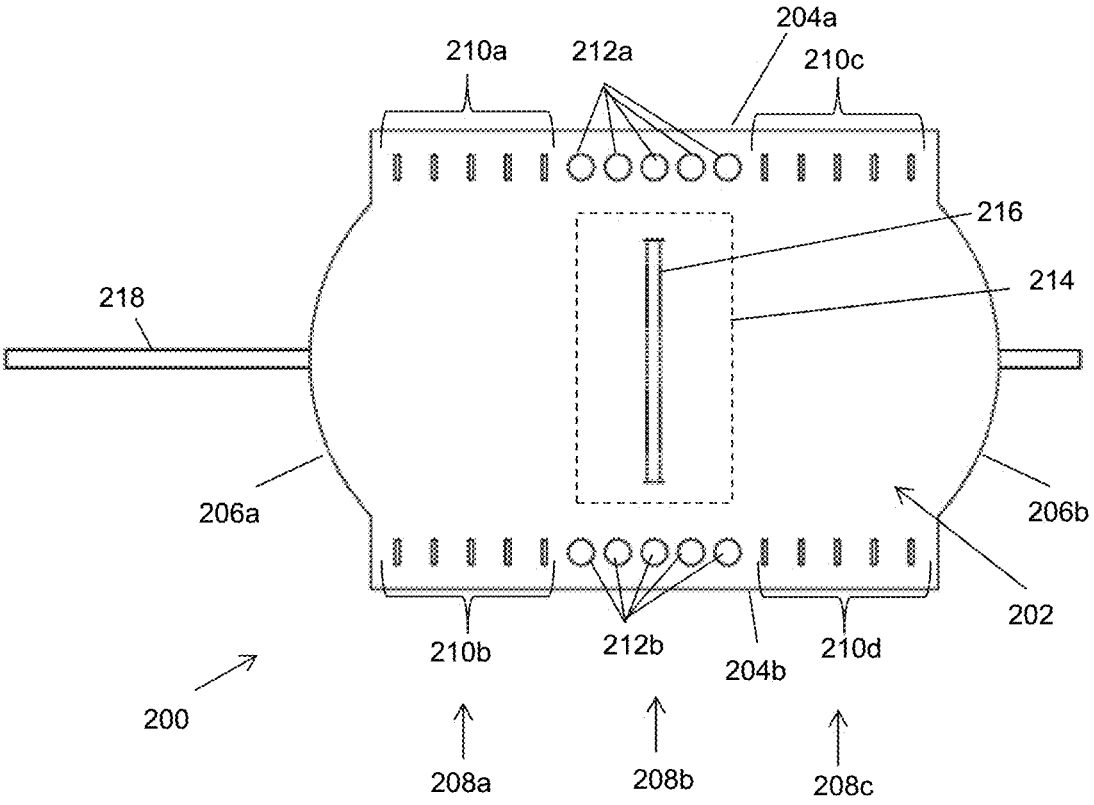
FIG. 2A shows a diagram illustrating a top view of an article according to a further example embodiment.

FIG. 2A shows a diagram illustrating a top view of an article 200 according to a further example embodiment. The article 200 comprises an outer layer 202, shown in FIG. 2A in an unfolded configuration. In an embodiment, the outer layer 202 is made of wool felt fabric in a substantially elongated shape. The outer layer 202 has a pair of longitudinal sides 204*a*, 204*b* and a pair of transverse sides 206*a*, 206*b*, which are in orthogonal directions with each other. The longitudinal sides 204*a*, 204*b* are straight and parallel to each other, while each of the transverse sides 206*a*, 206*b* has a profile of a circular flap.

The outer layer 202 is divided into three sections along the longitudinal direction, namely a left section 208*a*, a middle section 208*b*, and right section 208*c* with similar lengths. The outer layer 202 is foldable transversely such that the left and right sections 208*a*, 208*c* are placed substantially on top of the middle section 208*b*. The outer layer 202 comprises buttons and buttonholes that are disposed in a row adjacent the two longitudinal sides 204*a*, 204*b* of the outer layer 202. Specifically, the left section 208*a* has a set of buttonholes 210*a*, 210*b* disposed in a row adjacent each of the longitudinal sides, the right section 208*c* also has a set of buttonholes 210*c*, 210*d* disposed in a row adjacent each of the longitudinal sides, and the middle section 208*b* has a set of buttons 212*a*, 212*b* disposed in a row adjacent each of the longitudinal sides. The button and buttonholes can be fastened together to secure the body within the outer pouch. Depending on the size of the body within the outer pouch, the size of the outer pouch is adjusted based on the extent the buttons 212*a*, 212*b* and the buttons holes 210*a*, 210*b*, 210*c*, 210*d* being fastened together. The adjustable outer pouch may advantageously minimise the movement of the body in the outer pouch during portage.

A liquid impermeable sheet (not shown) and an absorbent layer (not shown) are stitched to the middle section 208*b* of the outer layer 202. The stitching lines are shown in FIG. 2A with reference numeral 214. The liquid impermeable sheet and absorbent layer may advantageously prevent leakage of fluid to the outer layer 202. An inner layer (not shown) is lined on the inner side of the absorbent layer and stitched to the outer layer 202. The stitching lines are shown in FIG. 2A with reference numeral 216. The inner layer is configured to form an inner pouch to receive the body.

The outer layer 202 also comprises an outer layer strap 218 attached to an outside surface of the outer layer 202. The outer layer strap 218 is used for forming a loop around the outer pouch in the longitudinal direction and two ends of the outer layer strap 218 are tied together to form a more secure outer pouch. It will be appreciated that the loop can be formed by a single continuous strap, or two separate straps attached in lined with each other in the longitudinal direction.

Figure 2B:
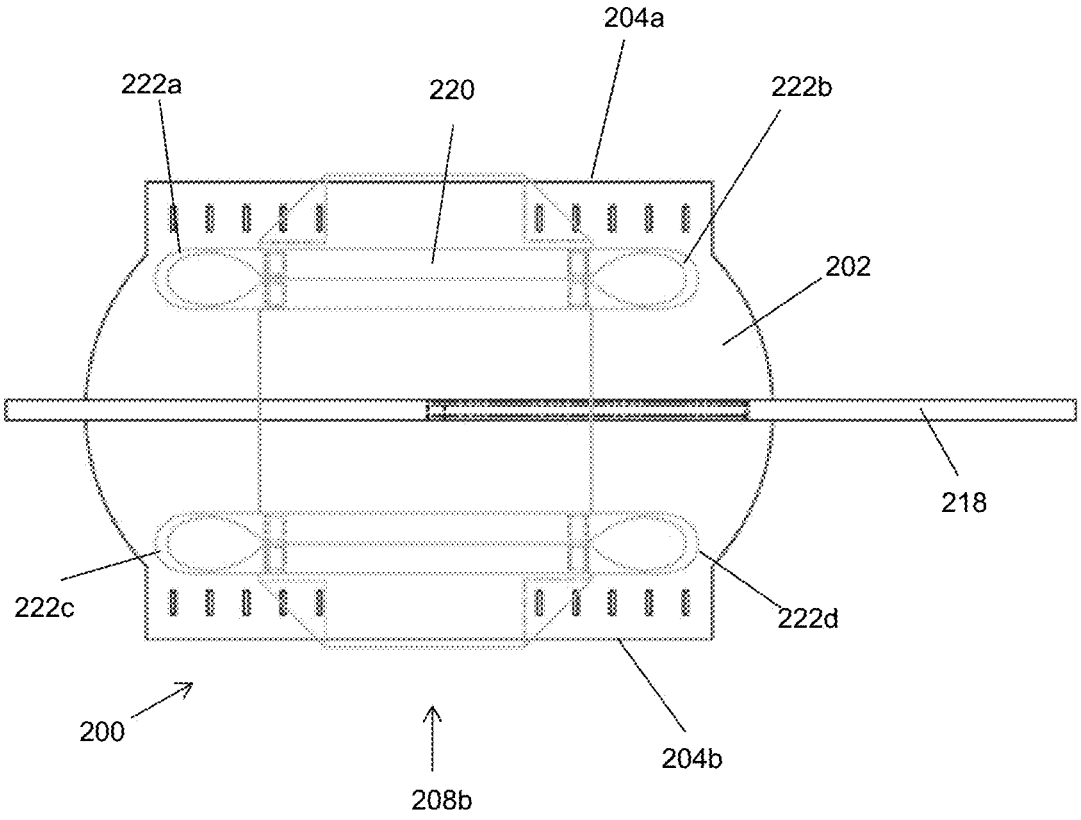
FIG. 2B shows a diagram illustrating a bottom view of the article in FIG. 2A.

FIG. 2B shows a diagram illustrating a bottom view of the article 200 in FIG. 2A. It is shown that the article 200 further comprises a cradle 220 attached to the outer side of the outer layer 202, at the middle section 208*b* of the outer layer 202. The cradle 220 is typically constructed of durable material. The cradle 220 may advantageously allow the outer pouch to be lifted and carried easily, and ensure the stability of the body when doing so. As shown in FIG. 2B, the cradle 220 comprises two pairs of handles oriented in parallel with the longitudinal sides 204*a*, 204*b* of the outer layer 202. The first pair of handles is represented as a first handle 222*a* and a second handle 222*b*. The second pair of handles is represented as a third handle 222*c* and a fourth handle 222*d*. Each handle extends outwardly in the longitudinal direction. A dowel rod (not shown) may be provided at each handle or to hold two handles together to provide additional strength to the handles. It will be appreciated that the cradle 220 can be detached from the article 200 if it is not required. The steps of using the article 200 are described in further details below in respect of FIGS. 3A-3F.

Figure 2C:
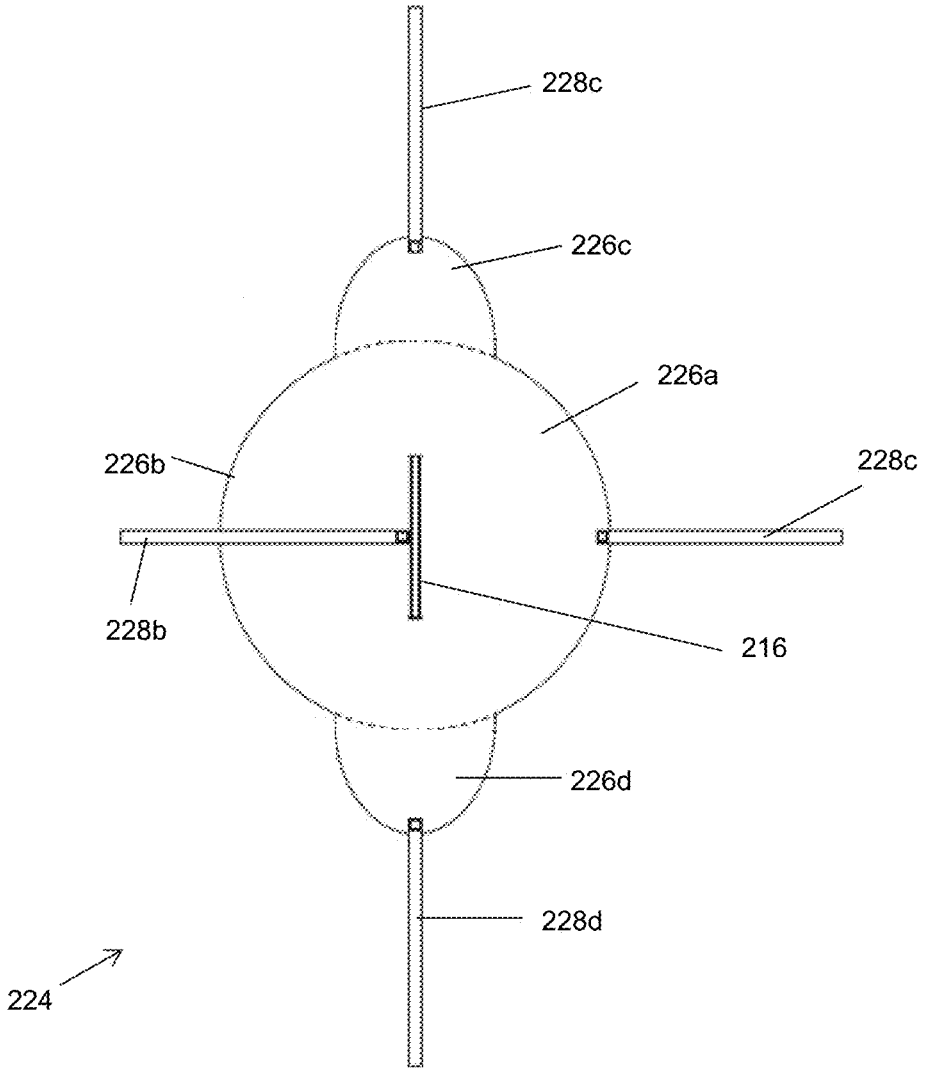
FIG. 2C shows a diagram illustrating a bottom view of a first inner layer that is suitable for use with the article in FIG. 2A.

FIG. 2C shows a diagram illustrating a bottom view of an inner layer 224 that is suitable for use with the article 200 in FIG. 2A. The inner layer 224 comprises four sides, each having a profile of a flap, represented in FIG. 2C as a left circular flap 226*a* and a right circular flap 226*b* that extend outwardly in the longitudinal direction, and an upper circular flap 226*c* and a lower circular flap 226*d* that extend outwardly in the transverse direction. It should be noted that the left and right circular flaps 226*a*, 226*b* are shown in FIG. 2C in the reverse orientations. This is because the bottom view shown in FIG. 2C is the view of the inner layer 224 that has been flipped sideways from an initial upward facing position.

The right circular flap 226*b* has a right side strap 228*b* that extends outwardly in the longitudinal direction. The right side strap 228*a* is stitched to the bottom of the inner layer 224 and adjacent to the centre of the inner layer 224. Each of the left, upper and lower circular flaps 226*a*, 226*c*, 226*d* has a strap attached adjacent to the tip of the respective circular flaps, represented in FIG. 2C as a left side strap 228*a*, an upper strap 228*c* and a lower strap 228*d*. The inner layer 224 is stitched to the outer layer 202. The stitching lines are shown in FIG. 2C with reference numeral 216.

Figure 2D:
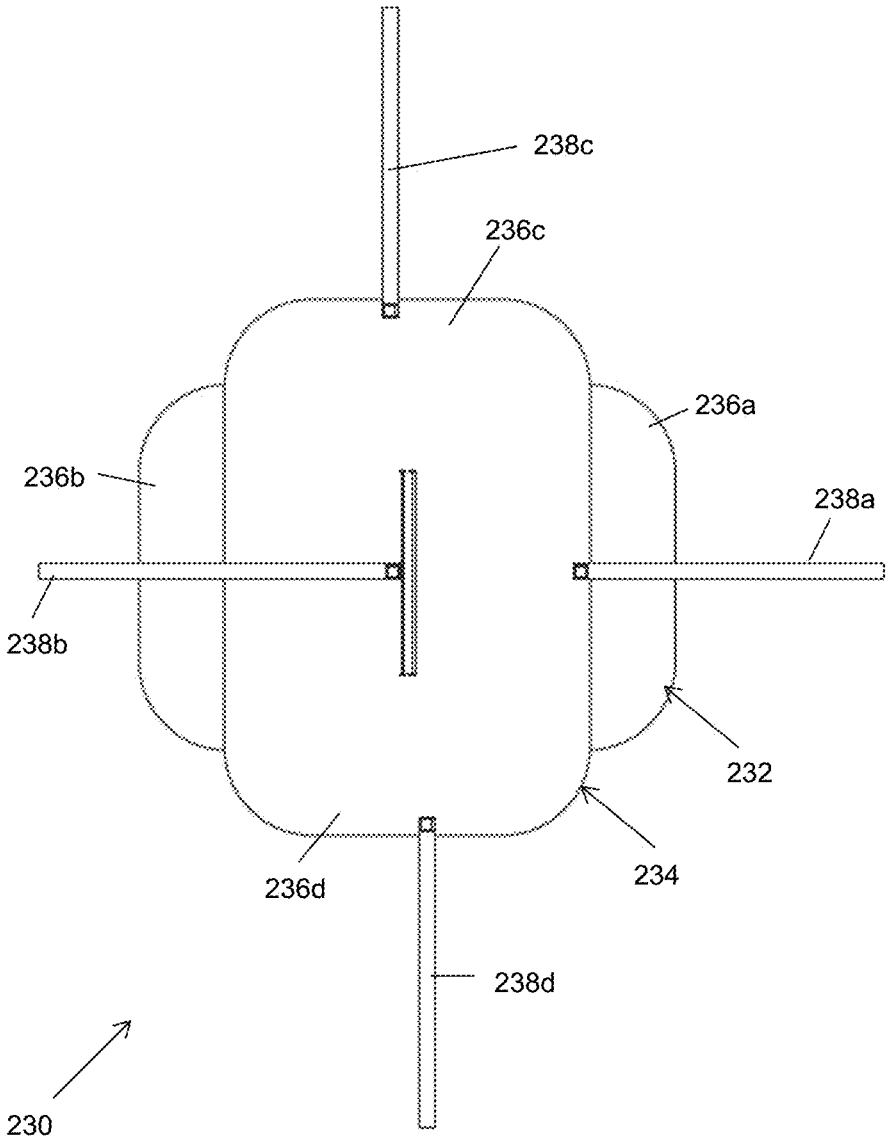
FIG. 2D shows a diagram illustrating a bottom view of a second inner layer that is suitable for use with the article in FIG. 2A.

FIG. 2D shows a diagram illustrating a bottom view of another inner layer 230 that is suitable for use with the article 200 in FIG. 2A. Here, two substantially rectangular layers of fabrics, represented as a first layer 232 and a second layer 234, are attached together at the centre of the layers 232, 234 with one placed orthogonally on top of the other, such that a cross-shaped inner layer 230 is formed. The inner layer 230 comprises four sides, each having a profile of a flap, represented in FIG. 2D as a left side flap 236*a* and a right side flap 236*b* that extend outwardly in the longitudinal direction, and an upper flap 236*c* and a lower flap 236*d* that extend outwardly in the transverse direction. Each of the flaps 236*a*, 236*b*, 236*c*, 236*d* has a strap that extends outwardly. The straps are represented as a left side strap 238*a*, a right side strap 238*b*, an upper strap 238*c* and a lower strap 238*d*.

The flaps of the inner layer 230 may be substantially wide, e.g 1.5 to 2 metres, to provide adequate material for fully enclosing the bodies of extra-large animals both length-ways and width-ways. The overlap arrangement between the first layer 232 and the second layer 234 to form the inner layer 230 may advantageously obviate the use of a fabric having a larger width if the inner layer 230 is made of a single layer of fabric.

The article 200 would be marketed under the trade name "cocoon". The "cocoon" comes in different sizes and can receive a medium to large pet animal having weight up to 90 kilograms.

Figure 3A:
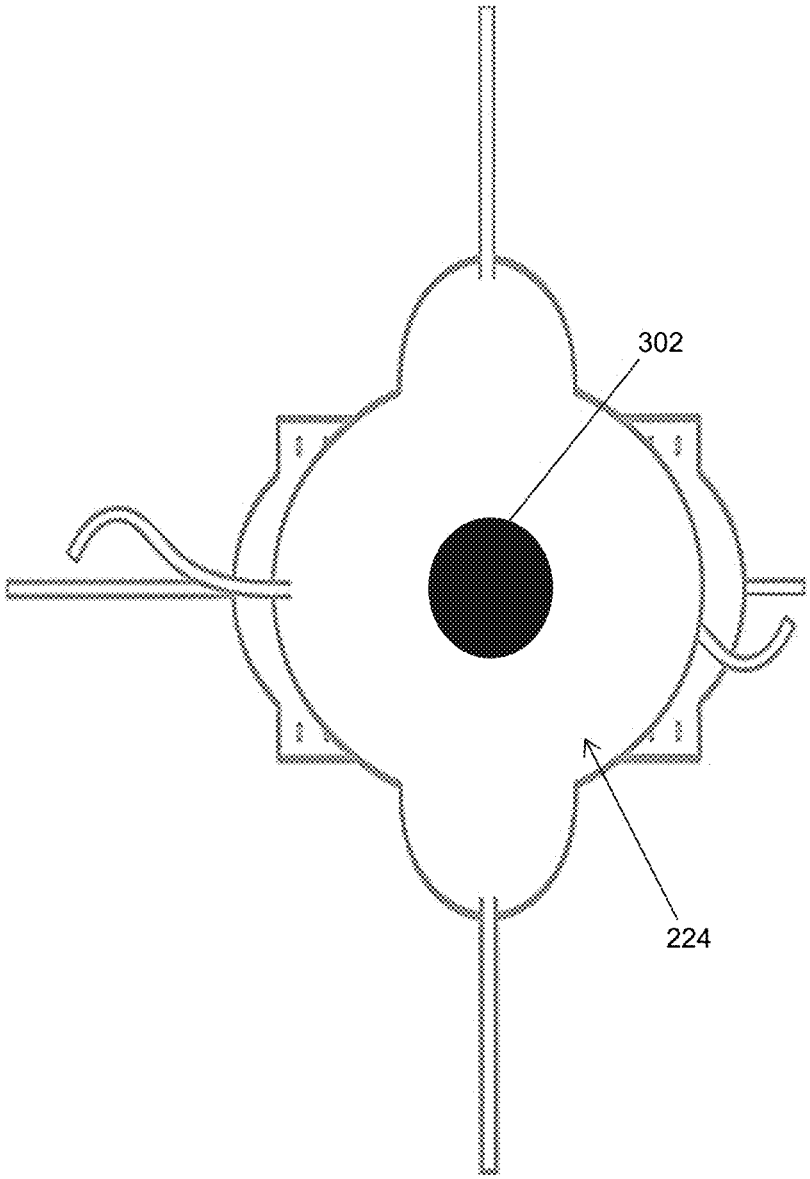
FIG. 3A shows a diagram illustrating the inner layer laid out flat for receiving a body of a deceased animal when using the article in FIGS. 2A-2C.
Figure 3B:
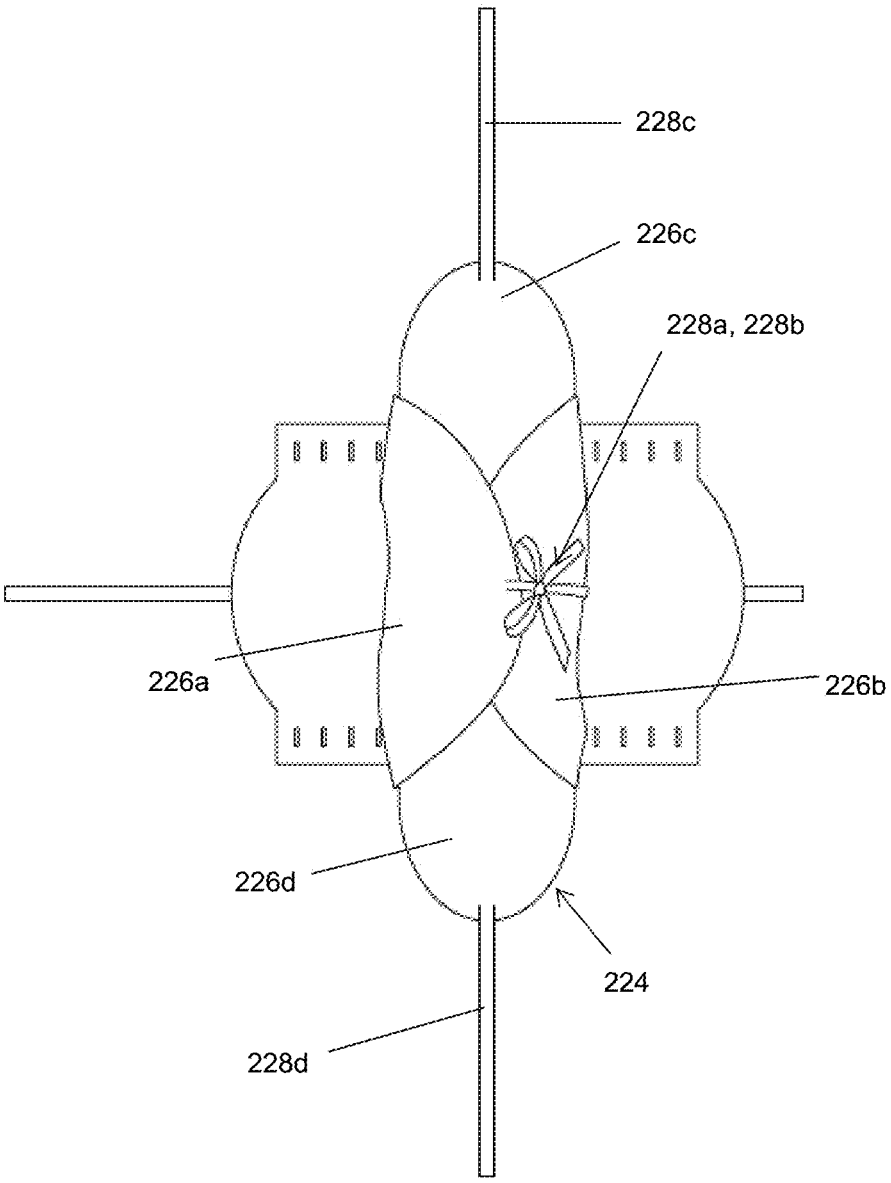
FIG. 3B shows a diagram illustrating left and right circular flaps of the inner layer being folded inward to wrap around the body when using the article in FIGS. 2A-2C.
Figure 3C:
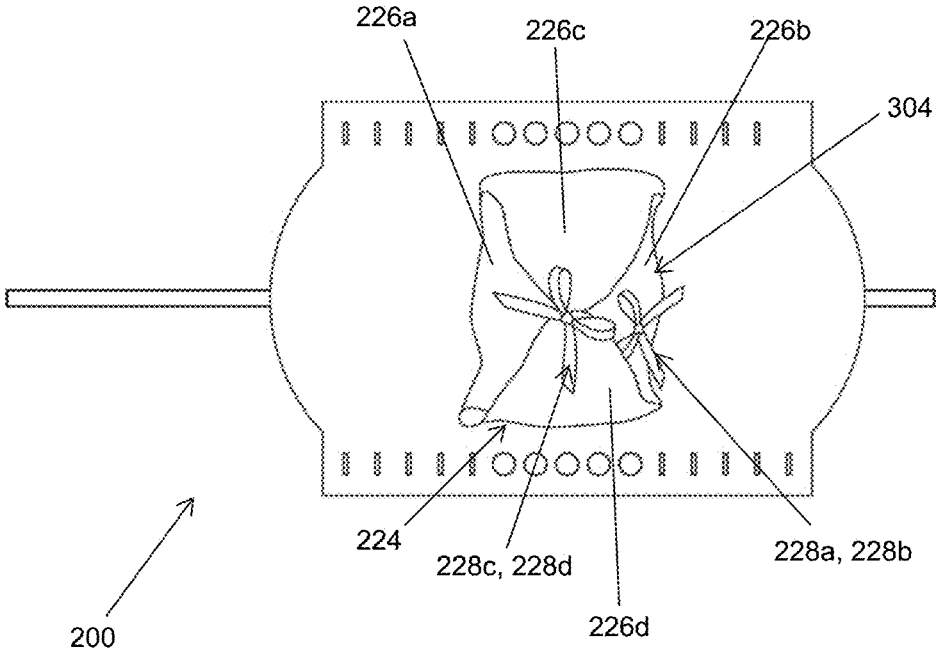
FIG. 3C shows a diagram illustrating upper and lower circular flaps of the inner layer being folded inward to wrap around the body when using the article in FIGS. 2A-2C.

FIGS. 3A to 3F show diagrams illustrating the steps of using the article 200 described in FIGS. 2A to 2C. In FIG. 3A, the inner layer 224 is laid out flat. A body 302 of a deceased animal is placed on the inner layer 224. In FIG. 3B, the left and right circular flaps 226*a*, 226*b* are folded inward to wrap around the body 302 and are secured together by tying the left side strap 228*a* and right side strap 228*b*. In FIG. 3C, the upper and lower circular flaps 226*c*, 226*d* are folded inward to wrap around the body 302 and are secured together by tying the upper strap 228*c* and lower strap 228*d*. Here, the inner layer 224 is formed into an inner pouch 304.

Figure 3D:
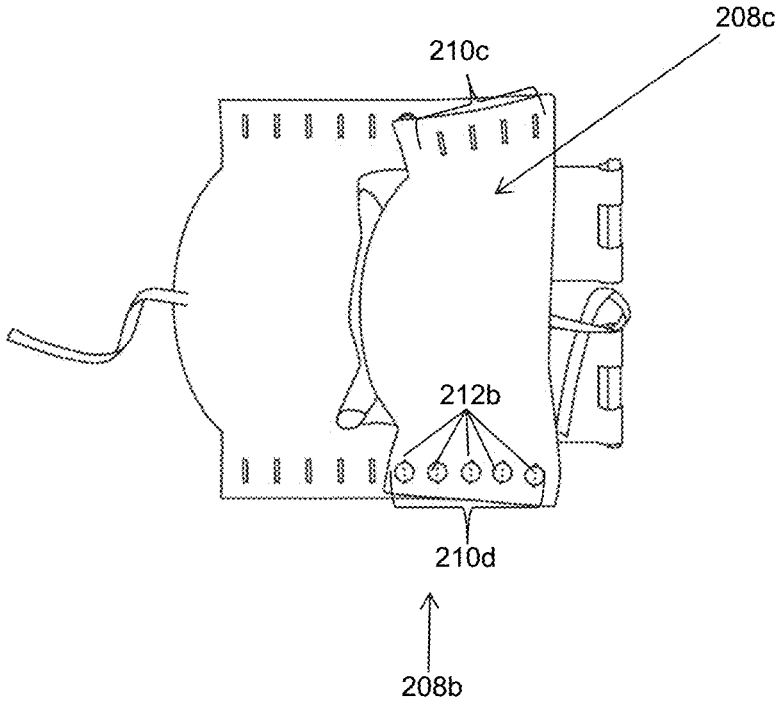
FIG. 3D illustrates a diagram illustrating a right section of the outer layer being folded inward to a middle section when using the article in FIGS. 2A-2C.
Figure 3E:
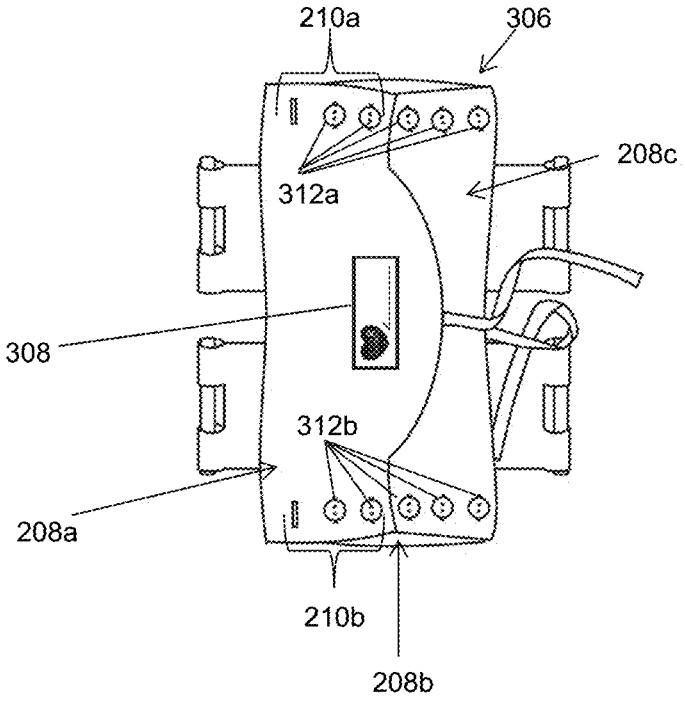
FIG. 3E shows a diagram illustrating a left section of the outer layer being folded inward to a middle section when using the article in FIGS. 2A-2C.
Figure 3F:
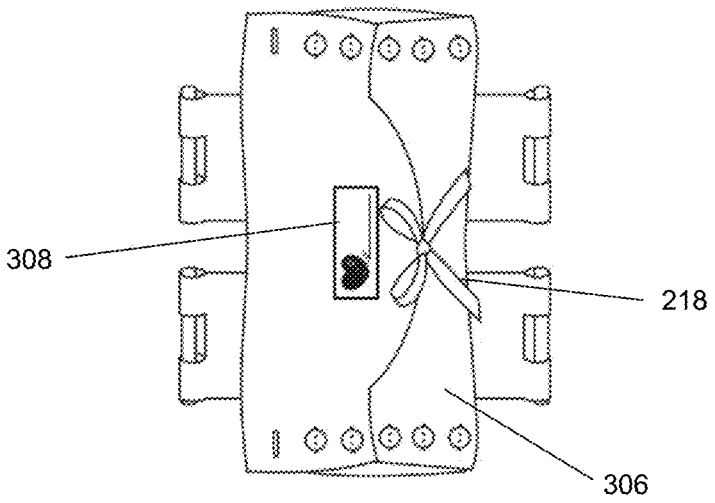
FIG. 3F shows a diagram illustrating an outer pouch formed with an outer layer strap being tied together when using the article in FIGS. 2A-2C.

In FIG. 3D, the right section 208*c* of the outer layer 202 is folded inward towards the middle section 208*b* and the buttonholes 210*c*, 210*d* at the right section 208*c* are fastened to the buttons 212*a*, 212*b* at the middle section at the respective sides. In FIG. 3E, the left section 208*a* is folded inward towards the middle section 208*b* and the buttonholes 210*a*, 210*b* at the left section 208*a* are fastened to the buttons 212*a*, 212*b* at the middle section 208*b* at the respective sides. The buttons holes 210*a*, 210*b*, 210*c*, 210*d* should be fastened together such that the body 302 is snugly fit in the outer pouch 306. In FIG. 3F, the outer layer strap 218 is tied together to form a more secure outer pouch 306. A name label 308 is provided at the outer side of the outer pouch 306. The pet owner may write the pet's name on the name label 308.

Figure 4A:
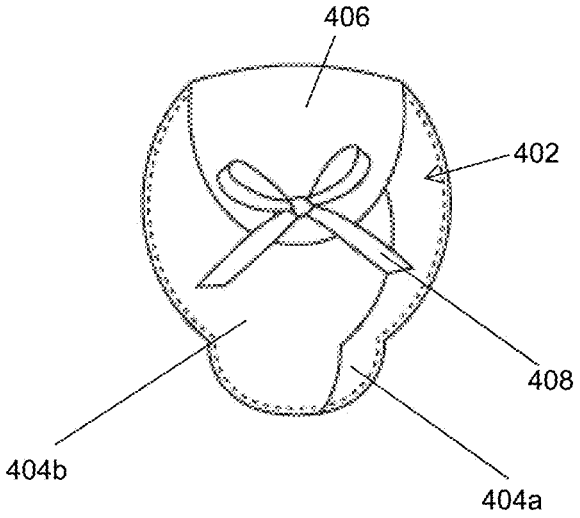
FIG. 4A shows a diagram illustrating a top view of an article according to a further example embodiment.

FIG. 4A shows a diagram illustrating a top view of an article according to a further example embodiment. The article, represented as a bag 400, comprises a sleeve 402. The sleeve 402 is configured to receive a body of a deceased animal via an opening (not shown) of the sleeve 402. The sleeve 402 comprises a panel (not shown), and a first flap 404*a* and a second flap 404*b* hinged to a left and right side of the panel respectively. Both the first and second flaps overlap with each other at the middle of the bag 400 such that the size of the bag 400 is adjusted based on the extent of the overlap.

The bag 400 comprises a closure flap 406 extended from the panel. As shown in FIG. 4A, the closure flap can be folded down to the sleeve 402 to close the opening, thereby forming a pouch. The bag 400 also has a tie 408 which extends from the first flap 404*a*. The tie 408 is threaded through corresponding slots at the second front panel 404*b* and the closure flap 406 respectively, and is tied to form a bow for securely holding the flaps together.

Figure 4B:
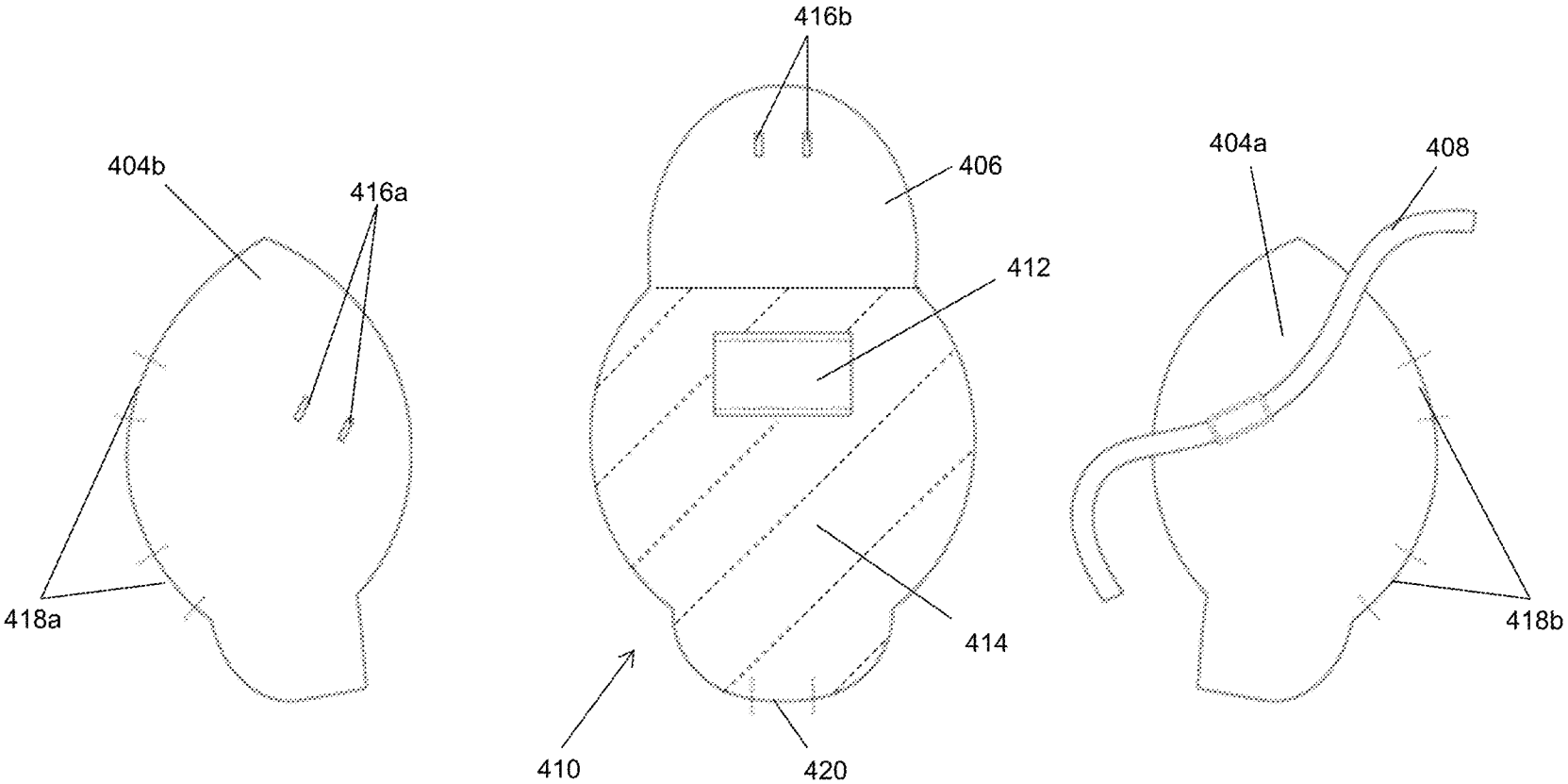
FIG. 4B shows a diagram illustrating the disassembled parts of the article in FIG. 4A.

FIG. 4B shows a diagram illustrating the disassembled parts of the bag 400 in FIG. 4A. Specifically, FIG. 4B shows a panel 410, a first flap 404*a* on the right of the panel 410, and a second flap 404*b* on the left of the panel 410. The bag 400 comprises a note pocket 412 attached to the inner side of the panel 410. Pet owners can slip a farewell note into the note pocket 412. The note pocket 412 with the farewell note can be used as a "pillow" to rest the head of the pet animal in the bag 400. The bag 400 further comprises an absorbent layer and a liquid impermeable sheet shielding the panel 410 to absorb fluid released from the body. The shielded area is shown in FIG. 4B with reference numeral 414.

The bag 400 has a tie 408 attached to the first flap 404*a*. The second flap 404*b* and the closure flap 406 comprises corresponding slots 416*a*, 416*b* respectively such that the tie 408 can be threaded through the slots 416*a*, 416*b* when the first and second flaps 404*a*, 404*b* and the closure flap 406 are drawn together to form the pouch. The first and second flaps 404*a*, 404*b* are folded at the peripheral sides, as shown in FIG. 4B with reference numeral 418*a* and 418*b*. The panel 410 is folded at the bottom, as shown in FIG. 4B with reference numeral 420. The folded parts form gussets which may advantageously allow the depth of the bag 400 to be adjusted.

The bag 400 would be marketed under the trade name "cloud". The "cloud" bag 400 is a snug pouch for small animals, e.g. guinea pigs, rabbits, and small cats or dogs.

Typically, the "cloud" bag 400 does not require carrying capability due to the small size of the pet animals it receives. The adjustable sleeve 402 allows the pet animals to be easily nestled within the "cloud" bag 400.

Figure 5A:
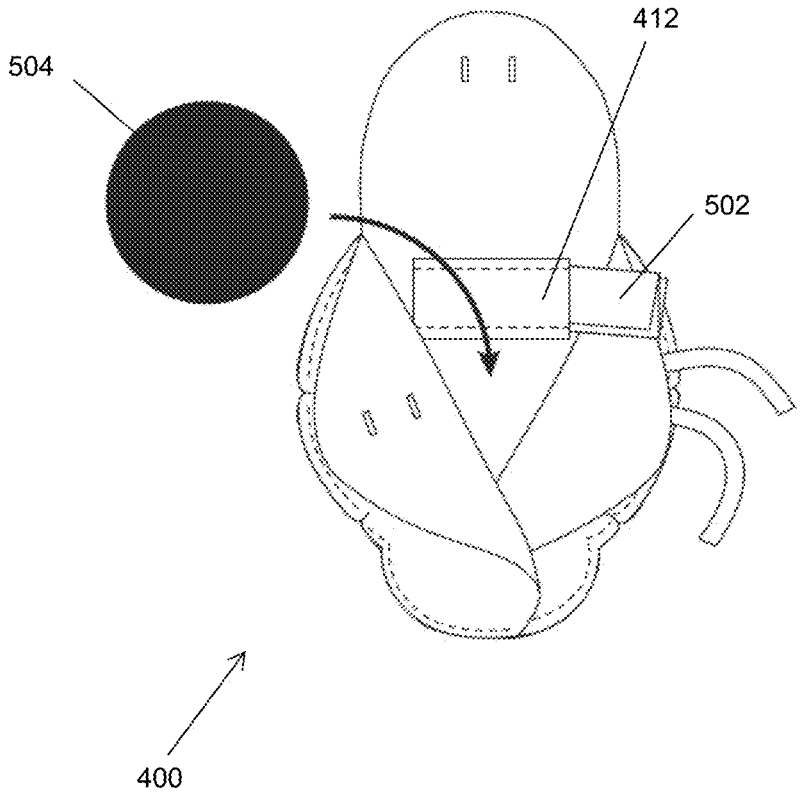
FIG. 5A shows a diagram illustrating insertion of a body and a farewell note into the article in FIG. 4A.
Figure 5B:
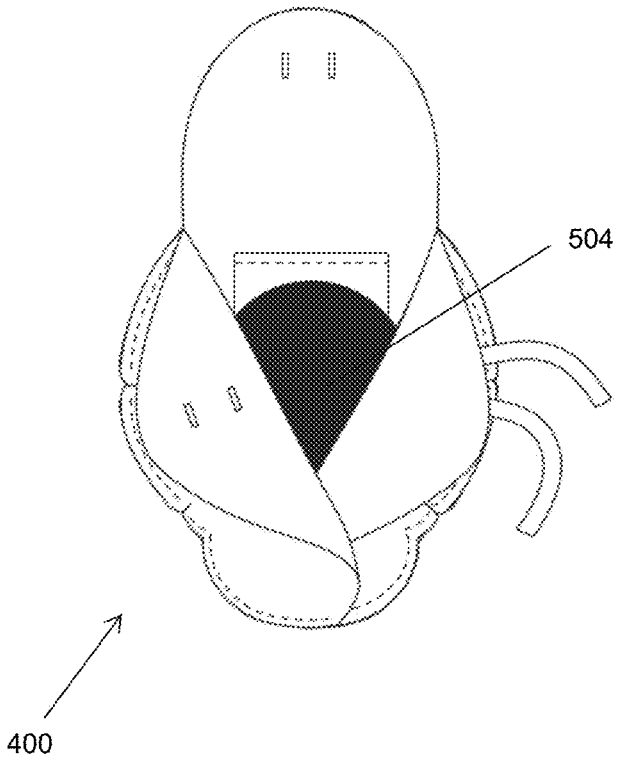
FIG. 5B shows a diagram illustrating the body being placed inside the article in FIG. 4A.
Figure 5C:
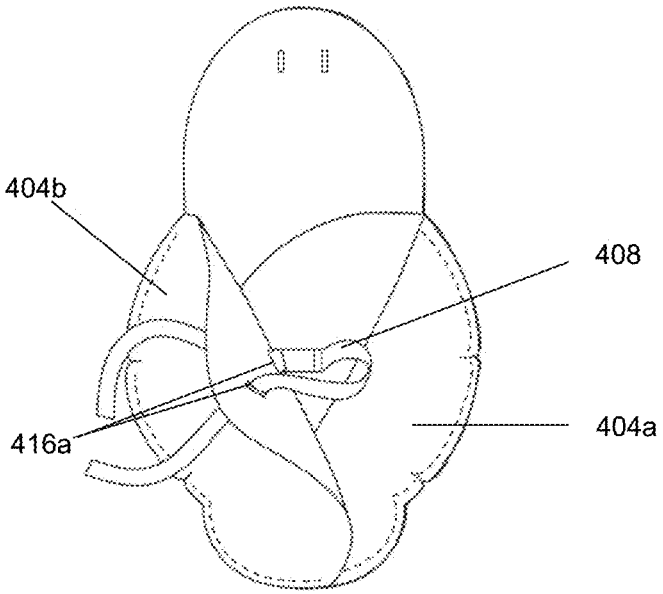
FIG. 5C shows a diagram illustrating a tie being threaded through the slots at a second panel when using the article in FIG. 4A.
Figure 5D:
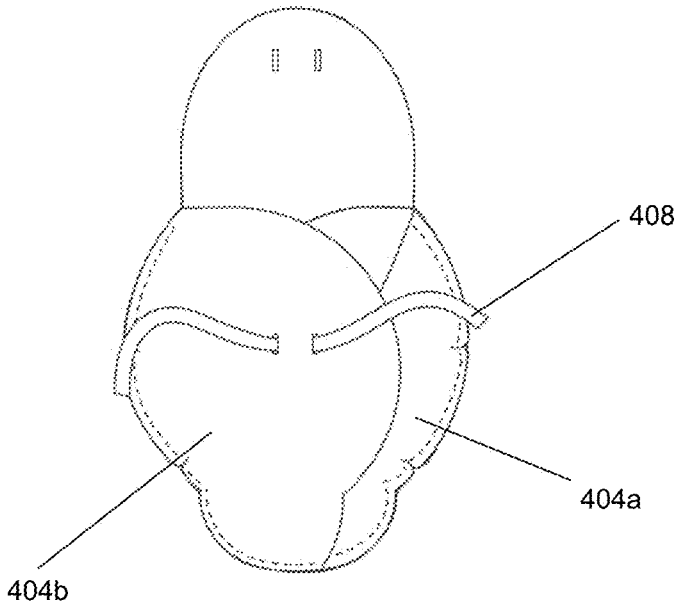
FIG. 5D shows a diagram illustrating the second flap being adjusted to form a snug fit in the article in FIG. 4A.
Figure 5E:
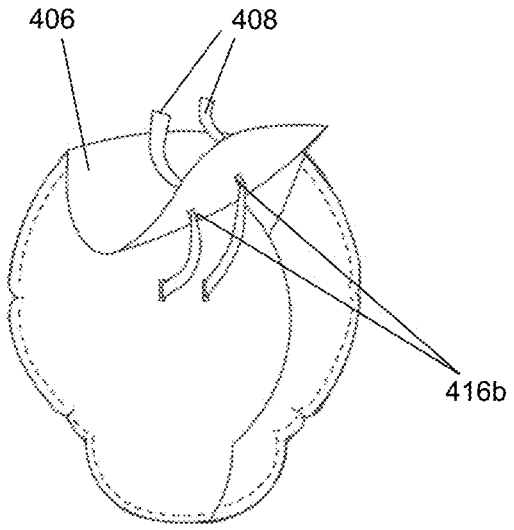
FIG. 5E shows a diagram illustrating a closure flap being folded down and the tie being threaded through the slots at the closure flap when using the article in FIG. 4A.
Figure 5F:
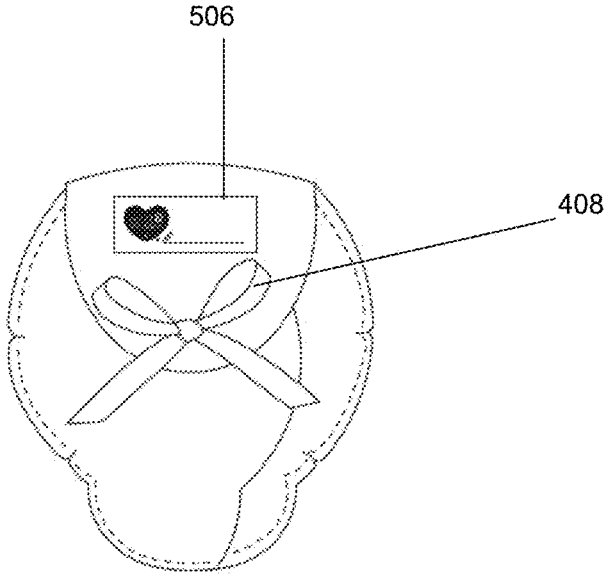
FIG. 5F shows a diagram illustrating the article in FIG. 4A formed with a bow tied to securely hold the flaps together.

FIGS. 5A to 5F show diagrams illustrating the steps of using the bag 400 described in FIGS. 4A and 4B. In FIG. 5A, a farewell note 502 is slipped into the note pocket 412. A body 504 of a deceased animal is inserted into the bag 400. In FIG. 5B, the body 504 is adjusted such that the body 504 is as far into the bag 400 as possible such that the body 504 is snugly wrapped. In FIG. 5C, the tie 408 is threaded through the slots 416*a* at the second flap 404*b*. In FIG. 5D, the second flap 404*b* is closed and the tie 408 is pulled gently to tighten around the body 504. In FIG. 5E, the closure flap 406 is folded down and the tie 408 is threaded through the slots 416*b* at the closure flap 406. In FIG. 5F, a bow is tied to securely hold the flaps together. A name label 506 is provided at the outer side of the closure flap 406 for the pet owner to write the pet's name.

The absorbent layer and liquid impermeable sheet in the example embodiments are lined to the hand-woven, water repellent wool felt layer to manage fluid released from the body. This may prevent leakage of fluid from the bag. Also, the adjustability of the bag and the availability of the bag in wide range of sizes ensure that the body is snugly fit in the bag, thus maintaining the positioning of the body in the bag. The bag may also comprise cradle which allows the bag to be lifted and carried easily. Other advantages of the bag may include the environmentally-friendly feature of the bag due to the use of biodegradable materials, ceremonial nature of the design, lightweight, and flexibility of the bag.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

What is claimed is:

1. An article for receiving a body of an animal, the article comprising:

an absorbent layer comprising an inner side and an outer side opposite the inner side, wherein the absorbent layer is configured to be placed proximate to the body to absorb fluid released from the body;

a liquid impermeable sheet attached to the outer side of the absorbent layer and configured to prevent the fluid released from the body from seeping through the liquid impermeable sheet; and an outer layer attached to the liquid impermeable sheet, wherein at least the outer layer forms an outer pouch to contain the body, and wherein the outer layer comprises closure means configured to secure the body within the outer pouch.

2. The article as claimed in claim 1, further comprising an inner layer attached to the inner side of the absorbent layer, wherein the inner layer forms an inner pouch to directly receive the body therein.

3. The article as claimed in claim 1, wherein the absorbent layer, liquid impermeable sheet, and outer layer are made of biodegradable materials.

4. The article as claimed in claim 1, wherein the absorbent layer comprises one or more towels made of natural fiber.

5. The article as claimed in claim 1, wherein the liquid impermeable sheet comprises one or more bioplastic sheets.

6. The article as claimed in claim 1, wherein the outer layer is made of a fluid-repellent material.

7. The article as claimed in claim 6, wherein the outer layer is made of wool felt.

8. The article as claimed in claim 1, wherein the closure means provides the outer pouch is adjustable in size.

9. The article as claimed in claim 8, wherein the closure means comprise overlapping flaps such that the size of the outer pouch is adjusted based on the extent of the overlap.

10. The article as claimed in claim 8, wherein the closure means comprises a plurality of buttons and a plurality of buttonholes, wherein the size of the outer pouch is adjusted based on the extent the plurality of buttons and buttonholes being fastened together.

11. The article as claimed in claim 1, further comprising a cradle attached to the outer layer, wherein the cradle is configured to allow the outer pouch to be lifted and carried.

* * * * *